US009357862B2

(12) United States Patent
Scheyer et al.

(10) Patent No.: US 9,357,862 B2
(45) Date of Patent: Jun. 7, 2016

(54) FRAME ASSEMBLY AND METHOD OF MANUFACTURING THE SAME

(71) Applicant: MCS Industries, Inc., Easton, PA (US)

(72) Inventors: James Scheyer, Northbrook, IL (US); Matthew S. Kressin, Bethlehem, PA (US)

(73) Assignee: MCS INDUSTRIES, INC.

( * ) Notice: Subject to any disclaimer, the term of this patent is extended or adjusted under 35 U.S.C. 154(b) by 356 days.

(21) Appl. No.: 13/630,112

(22) Filed: Sep. 28, 2012

(65) Prior Publication Data

US 2013/0185973 A1 Jul. 25, 2013

Related U.S. Application Data

(60) Provisional application No. 61/540,304, filed on Sep. 28, 2011.

(51) Int. Cl.
*A47G 1/06* (2006.01)

(52) U.S. Cl.
CPC ..... *A47G 1/065* (2013.01)

(58) Field of Classification Search
CPC ..... A47G 1/065
USPC ..... 40/735, 711, 732, 734
See application file for complete search history.

(56) References Cited

U.S. PATENT DOCUMENTS

| | | | | | |
|---|---|---|---|---|---|
| 2,593,195 | A * | 4/1952 | Rosenberg et al. | ..... | 40/735 |
| 4,639,725 | A | 1/1987 | Franke | | |
| 4,964,231 | A | 10/1990 | De Maat et al. | | |
| 5,172,504 | A | 12/1992 | De Maat et al. | | |
| 5,305,537 | A | 4/1994 | Pascarelli | | |
| 5,361,522 | A * | 11/1994 | Green | ..... | 40/725 |
| 5,377,434 | A | 1/1995 | Wilson | | |
| 5,819,458 | A * | 10/1998 | Hadden | ..... | 40/782 |
| 5,887,369 | A * | 3/1999 | Danielczak | ..... | 40/428 |
| 6,012,245 | A | 1/2000 | Squitieri | | |
| 7,418,796 | B2 * | 9/2008 | Anastasio | ..... | 40/735 |
| 7,530,190 | B2 * | 5/2009 | Isayev et al. | ..... | 40/793 |
| 2010/0324189 | A1 | 12/2010 | Brockmuller et al. | | |
| 2013/0031818 | A1 * | 2/2013 | Kim | ..... | 40/735 |

* cited by examiner

*Primary Examiner* — Syed A Islam
(74) *Attorney, Agent, or Firm* — Belles Katz LLC

(57) ABSTRACT

A frame assembly comprising an outer frame and a divider that divides a display opening of the outer frame into at least a first display window and a second display window. In one embodiment, the divider is molded while components of the outer frame are extruded. In another embodiment, the divider is coupled to the outer frame by sandwiching a portion of the divider between a glazing and the outer frame, and wherein relative movement between the divider and the outer frame is prohibited by interference between retaining features of one or both of the divider and the outer frame. The divider can be removed from the outer frame by simply removing the glazing and taking the divider out of the rabbet without damaging the outer frame. The same outer frame can be used without the divider. In another embodiment, the materials of the outer frame and divider are selected to achieve low cost production with improved visual characteristics.

7 Claims, 11 Drawing Sheets

FRAME ASSEMBLY AND METHOD OF MANUFACTURING THE SAME

The present application claims the benefit of U.S. Provisional Patent Application Ser. No. 61/540,304 filed Sep. 28, 2011, the entirety of which is incorporated herein by reference.

FIELD OF THE INVENTION

The present invention relates generally to frames and methods of manufacturing the same, and specifically to frame assemblies comprising an outer frame and a divider that divides the display opening into a plurality of display windows.

BACKGROUND OF THE INVENTION

People often enjoy commemorating their achievements or memorializing a particular life event by framing a diploma or a photograph. Often times, individuals desire to place multiple photographs or other items within a single outer frame. This is achieved by using it single outer frame in which a plurality of display windows that are visually or physically separated from one another are formed within the single outer frame. Frames having multiple display windows for simultaneously displaying more than one picture, poster, puzzle, jersey or other item are typically manufactured out of a single material. In certain instances, this single material construction can be overly expensive to manufacture due to the cost of the material. In other instances, it can be difficult to achieve a desirable aesthetic finish on the particular material used.

Thus, a need exists for a frame assembly, and method of manufacturing the same, in which a plurality of items can be displayed simultaneously (each in its own display window) that is cost-effective to manufacture and contains a desired aesthetic finish. A need also exists for a frame assembly in which the user can convert said frame assembly between a single window frame and a multi-window frame easily and without damaging (or compromising the aesthetics of) the outer frame.

SUMMARY OF THE INVENTION

In one embodiment, the invention can be a frame assembly comprising: an outer frame comprising an inner edge defining a display opening, the outer frame comprising a rabbet circumscribing the display opening; a divider coupled to the outer frame, the divider comprising: a divider frame having an inner edge defining a divider opening, the divider frame nesting within the rabbet; and a divider member having a first end connected to the divider frame and a second end connected to the divider frame, the divider member extending across the display opening to divide the display opening into at least a first display window and a second display window.

In another embodiment, the invention can be a frame assembly comprising: an outer frame comprising an inner edge defining a display opening, the outer frame comprising a core formed of a first material and a cap layer formed of a second material overlying the core and a divider member coupled to the outer frame, the divider member extending across the display opening to divide the display opening into at least a first display window and a second display window, the divider member formed of the second material.

In yet another embodiment, the invention can be a frame assembly comprising: an outer frame comprising an inner edge defining a display opening, the outer frame comprising a core formed of an expanded thermoplastic and a cap layer formed of a general purpose thermoplastic overlying the core; and a divider member coupled to the outer frame, the divider member extending across the display opening to divide the display opening into at least a first display window and a second display window, the divider member formed of a general purpose thermoplastic.

In still another embodiment, the invention can be a frame assembly comprising: an outer frame comprising an inner edge defining a display opening, the outer frame comprising a core formed of a material haying a first density and a cap layer formed of a material having a second density overlying the core; and a divider member coupled to the outer frame, the divider member extending across the display opening to divide the display opening into at least a first display window and a second display window, the divider member formed of a material having a third density, wherein the first density is less than the second and third densities.

In a further embodiment, the invention can be a frame assembly comprising: an outer frame comprising an inner edge defining a display opening, the outer frame comprising a core formed of an expanded thermoplastic and a cap layer formed of a non-expanded thermoplastic; and a divider member coupled to the outer frame, the divider member extending across the display opening to divide the display opening into at least a first display window and a second display window.

In an even further embodiment, the invention can be a frame assembly comprising: an extruded outer frame comprising an inner edge defining a display opening; and a molded divider member coupled to the extruded outer frame, the molded divider member extending across the display opening to divide the display opening into at least a first display window and a second display window.

In a yet further embodiment, the invention can be a frame assembly comprising: an outer frame comprising an inner edge defining a display opening, the outer frame comprising a foil layer forming an outer surface of the outer frame; and a divider member coupled to the outer frame, the divider member extending across the display opening to divide the display opening into at least a first display window and a second display window, the divider member comprising a foil layer forming an outer surface of the divider member.

In a still further embodiment, the invention can be a method of manufacturing a frame assembly comprising: a) extruding, a plurality of outer frame components; b) coupling the plurality of outer frame components together to form an outer frame having an inner edge defining a display opening c) molding a divider comprising a divider member; and d) coupling the divider to the outer frame so that the divider member extends across the display opening, and divides the display opening into at least a first display window and a second display window.

In another embodiment, the invention can be a method of manufacturing a frame assembly comprising: a) forming an outer frame having an inner edge defining a display opening; b) applying a first foil layer to the outer frame so that the first layer forms an outer surface of the outer frame; c) forming a divider comprising a divider member; d) applying a second foil layer to the divider member so that an outer surface of the divider member is formed by the second foil layer; and e) coupling the divider to the outer frame so that the divider member extends across the display opening and divides the display opening into at least a first display window and a second display window.

In yet another embodiment, the invention can be a frame assembly comprising: an outer frame comprising an inner edge defining a display opening, the outer frame comprising a rabbet circumscribing the display opening; and a divider coupled to the outer frame, the divider comprising a divider member having a first end nesting in the rabbet and a second end nesting in the rabbet, the divider member extending across the display opening to divide the display opening into at least a first display window and a second display window.

BRIEF DESCRIPTION OF THE DRAWINGS

The present invention will be described in detail below with respect to the drawings, in which.

DETAILED DESCRIPTION OF THE INVENTION

Figure 1:
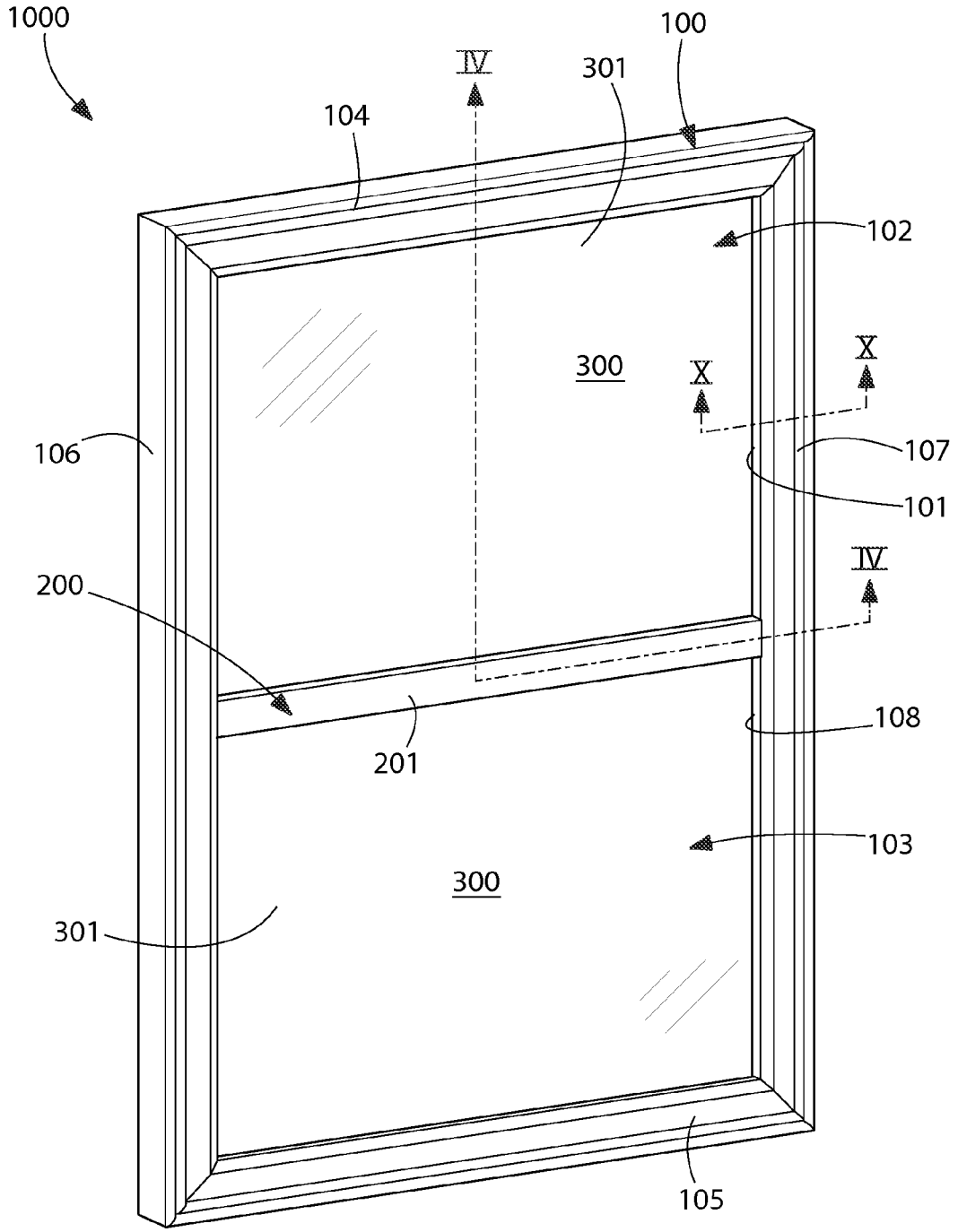
FIG. 1 is a front perspective view of a frame assembly in accordance with embodiment of the present invention.
Figure 2:
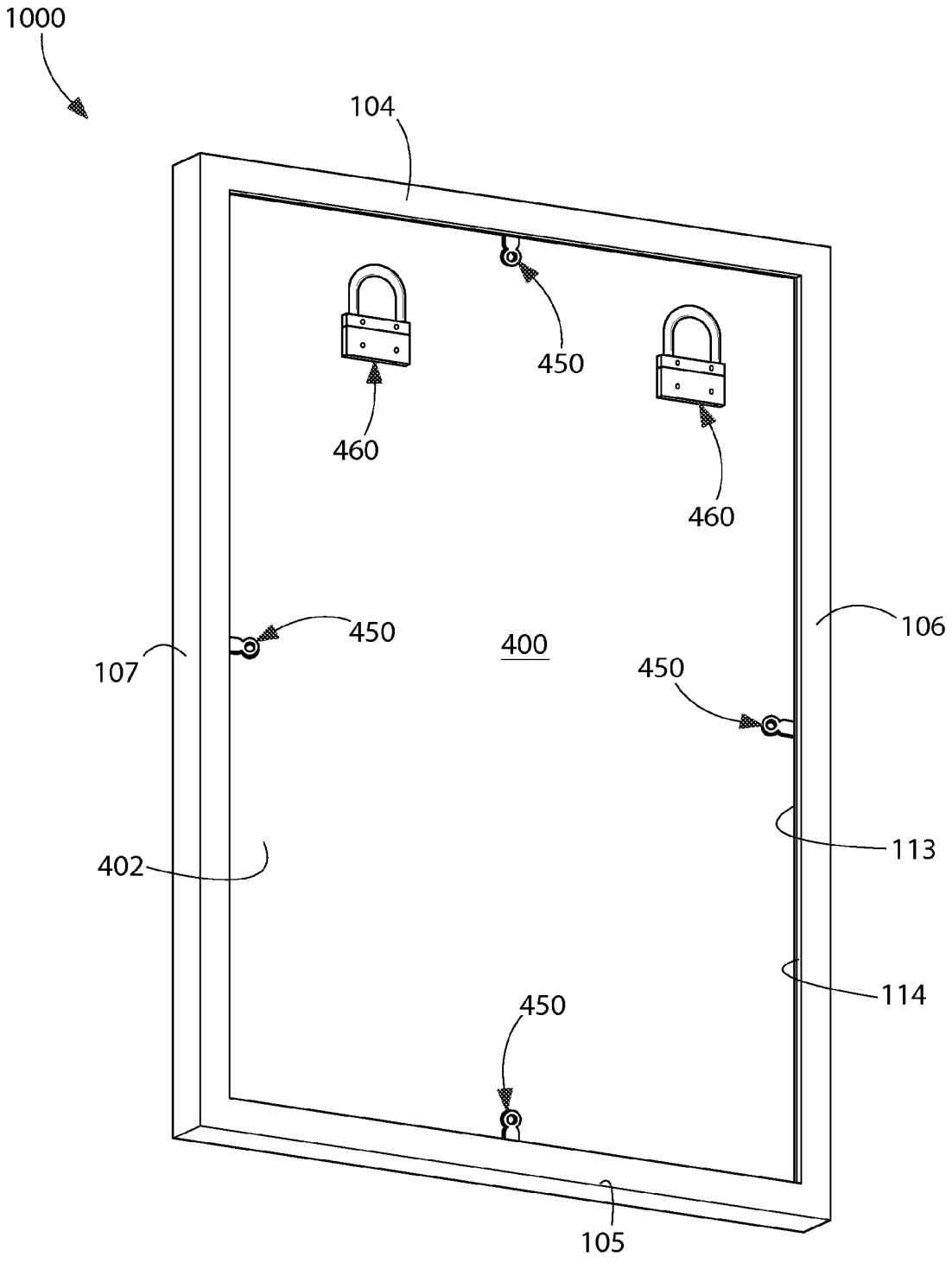
FIG. 2 is a rear perspective view of the frame assembly of FIG. 1.
Figure 3:
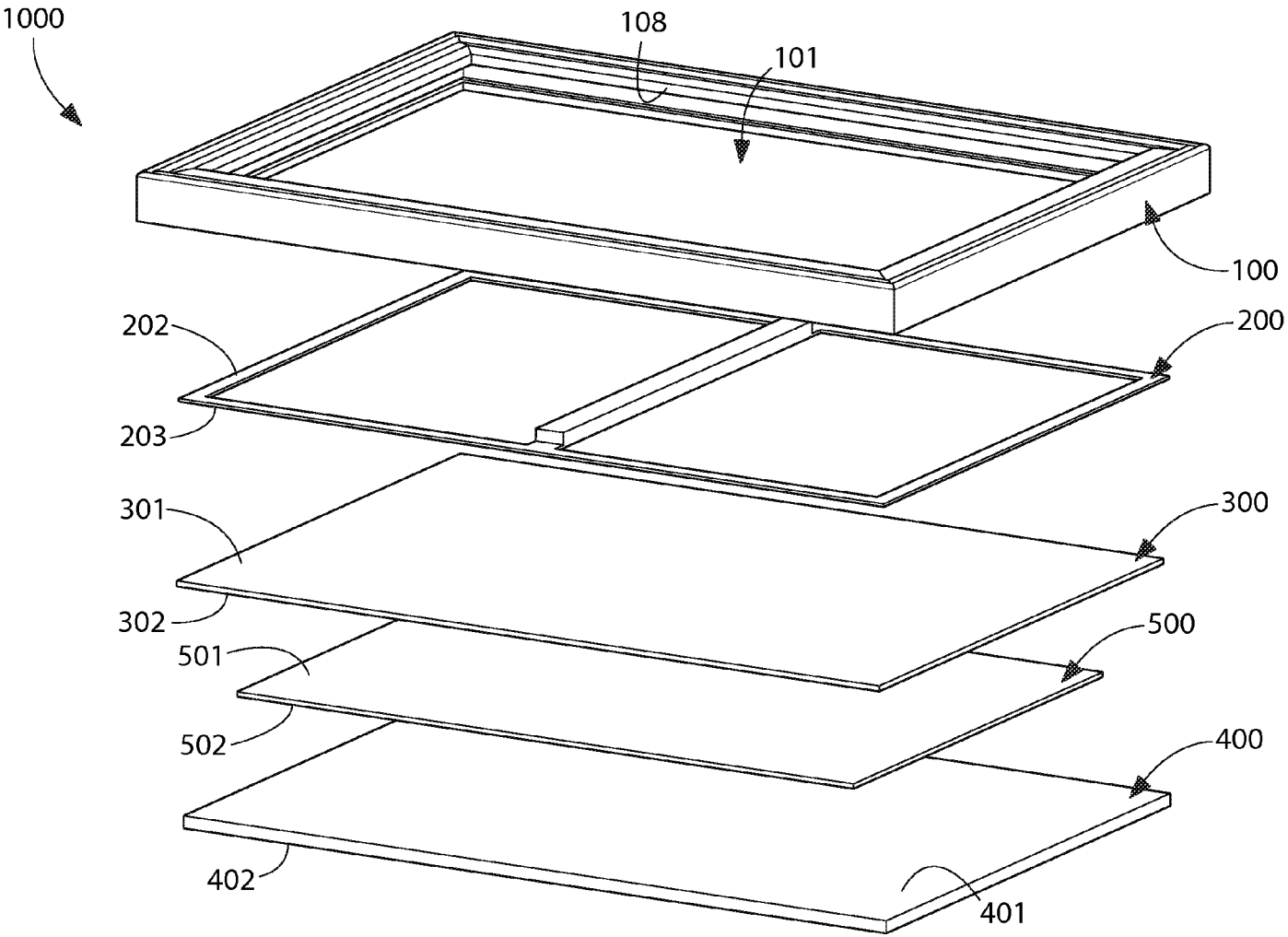
FIG. 3 is an exploded view of the frame assembly of FIG. 1.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal", "vertical," "above," "below," "up," "down" "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Further, the term "overlayed" and "overlying" refer to a relationship in which one layer is applied over another layer and/or structure, either directly or indirectly through the presence of intervening layers and/or structures. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIGS. 1-3 and 6A concurrently, a frame assembly 1000 according to an embodiment of the present invention is illustrated. The frame assembly 1000 generally comprises an outer frame 100, a divider 200, a glazing 300, a backer panel 400, a plurality of fasteners 450, and a plurality of support elements 460. When the divider 200 is part of the frame assembly 1000, the frame assembly 1000 is used to simultaneously display a plurality of desired objects 500, which are sandwiched between the glazing 300 and the backer panel 400. Examples of desired object(s) 500 include, without limitation, a picture(s), a jersey(ies), artwork, a poster(s), a diploma(s), a poster, a photograph(s), a puzzle(s), a newspaper(s), a magazine(s), other flat article(s), combinations thereof, or any other item that a user desires to display. Unless specifically recited in the claims, the present invention is not to be limited in any manner by the type of object(s) to be displayed therein.

As will be discussed below in greater detail, the divider 200 divides a display opening 101 of the outer frame 100 into a first display window 102 and a second display window 103 (shown in FIG. 1). In the exemplified embodiment, the first display window 102 and the second display window 103 are completely and structurally isolated from another by a divider member 201 of the divider 200. When the divider 200 is incorporated into the frame assembly 1000, the frame assembly 1000 is a multi-window frame type in which two items can be displayed simultaneously in an organized and visually distinct manner. In the exemplified embodiment, the divider member 201 divides the display opening 101 so that the first and second display windows 102, 103 are of substantially equal size and substantially the same shape. In other embodiments, the divider member 201 may be offset or otherwise shaped so that it divides the display opening 101 so that the first and second display windows 102, 103 are of substantially different sizes and/or different shapes. Each of the first and second display windows 102, 103 are of sufficient size such that a desired object 500 will be able to be positioned therein for viewing.

Furthermore, in the exemplified embodiment, the divider member 201 is a substantially linear structure that extends from one side of the display opening 101 to an opposite side of the display opening 101. The divider member 201, as exemplified, extends substantially parallel to the top and bottom frame components 104, 105 of the outer frame 100 and substantially perpendicular to the left and right side frame components 106, 107 of the outer frame 100. In other embodiments, however, the divider member 201 may be non-linear and/or may extend oblique to the frame components 104-107. in still other embodiments, the divider member 201 may be L-shaped, cruciform-shaped, a rectilinear grid shape, contoured, etc. In further embodiments, more than one divider member 201 may be included on a single divider 200 (see FIG. 10) so that the display opening 101 of the outer frame 100 is divided into more than two display windows 102, 103. In even other embodiments, more than one divider member 201, each part of separate and distinct dividers 200, can be used in conjunction with the outer frame 100 to divide the display opening 100 into more than two display windows.

Thus, in accordance with the present invention, the display opening 101 of the outer frame 100 can be divided into any number of display windows, including any desired shape and/or relative arrangement thereof. As will be discussed in greater detail below, in certain embodiments of the invention, the divider 200 may be omitted entirely and the frame assembly could be of the single window type. The structural, formation and material details of the divider 200 and the outer frame 100 will be described in greater detail below.

The glazing 300 can be any type of glazing that is used for framing. In certain embodiments, the glazing 300 will be a panel of glass, acrylic, plexiglass, polystyrene or other material that allows the viewing of an object 500 therethrough. Of course other materials can be used in other embodiments of the invention for the glazing 300. In certain embodiments, the glazing 300 is formed of a substantially transparent material so that the item(s) 500 being framed therein are visible through the glazing 300. As used herein, the term "transparent" includes the presence of colored tint. In other embodiments, the glazing 300 may be at least partially translucent. In still other embodiments of the invention, the glazing 300 may be omitted from the frame assembly 100.

The backer panel 400 can be formed of a hard or soft plastic materials, such as any of the thermoplastics discussed below. Alternatively, the backer panel 400 can be formed of a cardboard, wood, metal or other material as desired. In certain embodiments, the backer panel 400 may be a ring-like structure rather than a sheet-like structure. In other embodiments, the frame assembly 1000 may also include a filler panel between the backer panel 400 and the desired object 500. The filler panel takes up space and reduces potential damage by adding a layer of protection for the object(s) 500. The filler panel can also be used to provide the necessary thickness to the stack to ensure adequate compression to hold the stack in the outer frame 100 (discussed below). The filler panel is a sheet of corrugated material or other medium, such as a corrugated metal, corrugated cardboard, plastic, fiberboard or the like. The filler sheet can be included with the frame assembly 1000 or omitted as desired.

When the frame assembly 1000 is assembled, each of the divider 200, the glazing 300, the backer panel 400, and the desired object(s) 500 are nested within a rabbet 110 of the outer frame 100 in a stacked arrangement. In terms of order of arrangement of the stack within the rabbet 110, the divider 200 is the front-most component within the rabbet 110 such that a front surface 202 of the divider 200 is abutted against and in surface contact with a floor surface 111 of the rabbet 110. The glazing 300 is positioned adjacent the divider 200 so that a front surface 301 of the glazing 300 is abutted against and in surface contact with a rear surface 203 of the divider 200. The object(s) 500, which is in the form of a flat article, is positioned adjacent the glazing 300 so that a front surface 501 of the object(s) 500 is abutted against and in surface contact with a rear surface 302 of the glazing 300. The rear panel 400 is positioned adjacent the object(s) 500 so that a front surface 401 of the rear panel 400 is abutted against and in surface contact with a rear surface 502 of the object(s) 500. As mentioned above, in certain embodiments (not illustrated), an additional filler panel can be positioned in between the object(s) 500 and the backer panel 400.

Figure 6A:
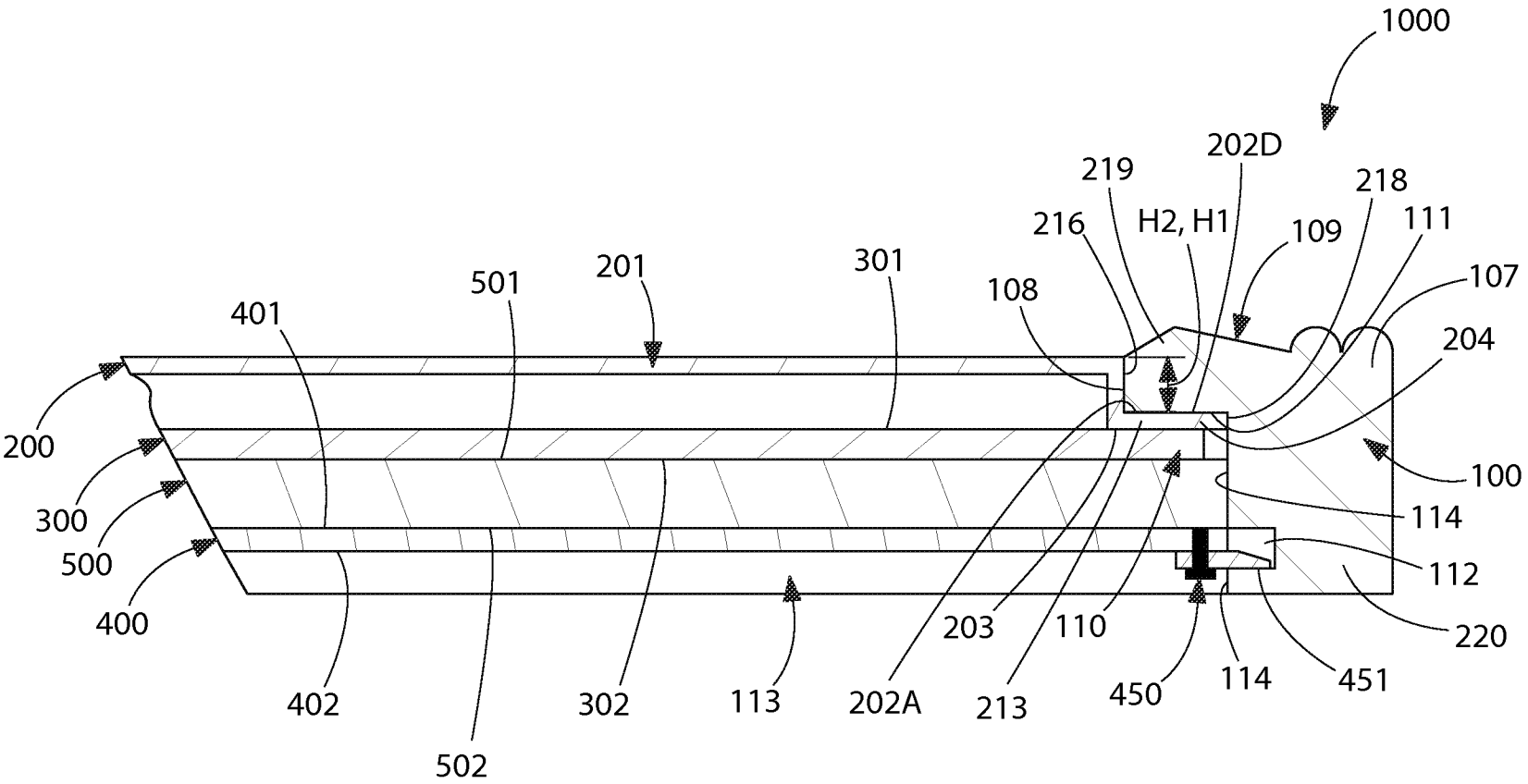
FIG. 6A is a cross-sectional view of the frame assembly of FIG. 1 taken along view IV-IV of FIG. 1.

As shown in FIGS. 1 and 6A, the frame assembly 1000 further comprises a plurality of fasteners 450. The fasteners 450 detachably couple the stack (i.e., the divider 200, the glazing 300, the object(s) 500 and the backer panel 400) to the outer frame 100. More specifically, the fasteners 450 detachably couple the stack 200, 300, 500, 400 to the outer frame 100 within the rabbet 110. As can be seen, in the exemplified embodiment, the entire stack (i.e., the divider 200, the glazing 300, the object(s) 500 and the backer panel 400) is coupled to the outer frame 100 solely by engagement between the rear panel 400 and the outer frame 100, which is effectuated by the fasteners 450. All other components in the stack (i.e., the divider 200 and the glazing 300) are solely in surface contact with the outer frame 100.

The fasteners 500 are adjustable between: (1) a locked state (FIG. 6A) in which tip portions 451 of the fasteners 450 extend into a channel 112 of the outer frame 100; and (2) an unlocked state in which the tip portions 451 of the fasteners 450 do not extend into the channel 112 of the outer frame 100, in the locked state, the fasteners 450 secure the stack 200, 300, 500, 400 within the rabbet 110 so that the stack 200, 300, 500, 400 cannot be removed from the rabbet 110 of the outer frame 100 without first adjusting the fasteners 450 to the unlocked state. The fasteners 450, in the exemplified embodiment, are turn buttons. In other embodiments, the fasteners 450 can take the form of flex tabs, clips, tangs, adhesive tabs, tape, slide locks, or other structures for detachably coupling the backer panel 400 (and in turn the rest of the stack 200, 300, 500) to the outer frame 100. Furthermore any number of fasteners 450 can be used, including without limitation more or less than four, including one, two, three, five, six, eight, etc.

In the exemplified embodiment, the fasteners 450 are rotatably secured to the rear surface 402 of the hacker panel 400. In other embodiments, however, some or all of the fasteners 450 can be secured to the outer frame 100. In such an embodiment, the fasteners 450 will be in a locked state when the fasteners engage the backer panel 400 (for example though contact with the rear surface 402 or mating with a mating feature provided, thereon) and in an unlocked state when the fasteners 450 disengage the backer panel 400 so as to allow the stack to be removed from the outer frame 100.

In certain embodiments, the fasteners 450 can be omitted entirely. In one such embodiment, the backer panel 400 can be sized so as that at least one if its dimensions (length and/or width) is slightly larger than the corresponding dimension of the rear opening 113 of the outer frame 100 that is defined by the rear edge 114. In such an embodiment, the rear panel 400 can be sufficiently flexible so that one end can be slid into the channel 112, the rear panel 400 bowed, and the other end of the rear panel 400 is slid into the opposite side of the channel 112. In still other embodiments, adhesive may be used instead of fasteners.

When the hacker panel 400 is secured to the outer frame 100 (as discussed above), the backer panel 400 retains the glazing 300, the object(s) 500 and the divider 200 in place within the rabbet 110. Thus, the backer panel 400 facilitates the formation of a secure, fully assembled frame assembly 1000 for display and protection of photographs or other items. Thus, in some embodiments, the divider 200 is only in surface contact with the outer frame 100 and not otherwise fixed to the outer frame 100 in any manner. Thus, the detachable coupling between the divider 200 and the outer frame 100 is accomplished without any fasteners (such as screws, bolts, clamps, clips) or adhesives directly binding the two together. The divider 200 can be removed from the outer frame 100 by simply disengaging the backer panel 400 from the outer frame 100, removing the backer panel 400 and glazing 300, and lifting the divider 200 from the rabbet 110.

The frame assembly 1000 further comprises a plurality of support elements 460. The support elements 460, in the exemplified embodiment, are used to hang the frame assembly 1000 on a wall or other upstanding surface. The support elements 460 are illustrated in the form of hanger plates but can take on any other structures known for hanging frames, including without limitation, brackets, eye hooks, undercuts, dual-sided adhesive tabs, or the like. In the exemplified embodiment, the support elements 460 are secured to the rear surface 102 of the backer panel 400. In other embodiments, however, some or all of the support elements 460 can be secured to (or integrally formed into) the outer frame 100. In still other embodiments, the support element 460 can be of the type used to support the frame assembly 1000 so that it is a self-standing frame, such as an easel.

Figure 4A:
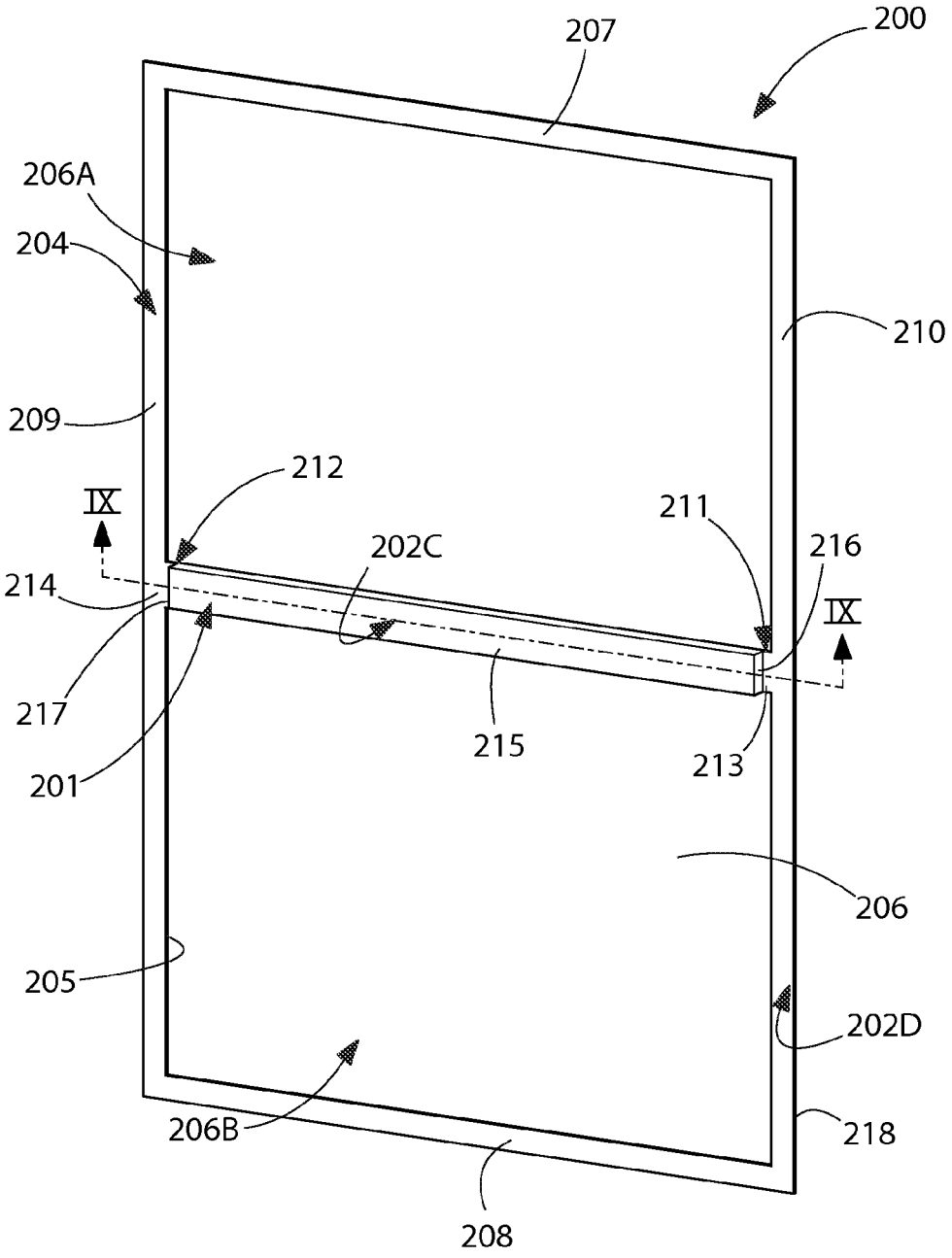
FIG. 4A is a front perspective view of a divider of the frame assembly of FIG. 1 in accordance with an embodiment of the present invention.
Figure 4B:
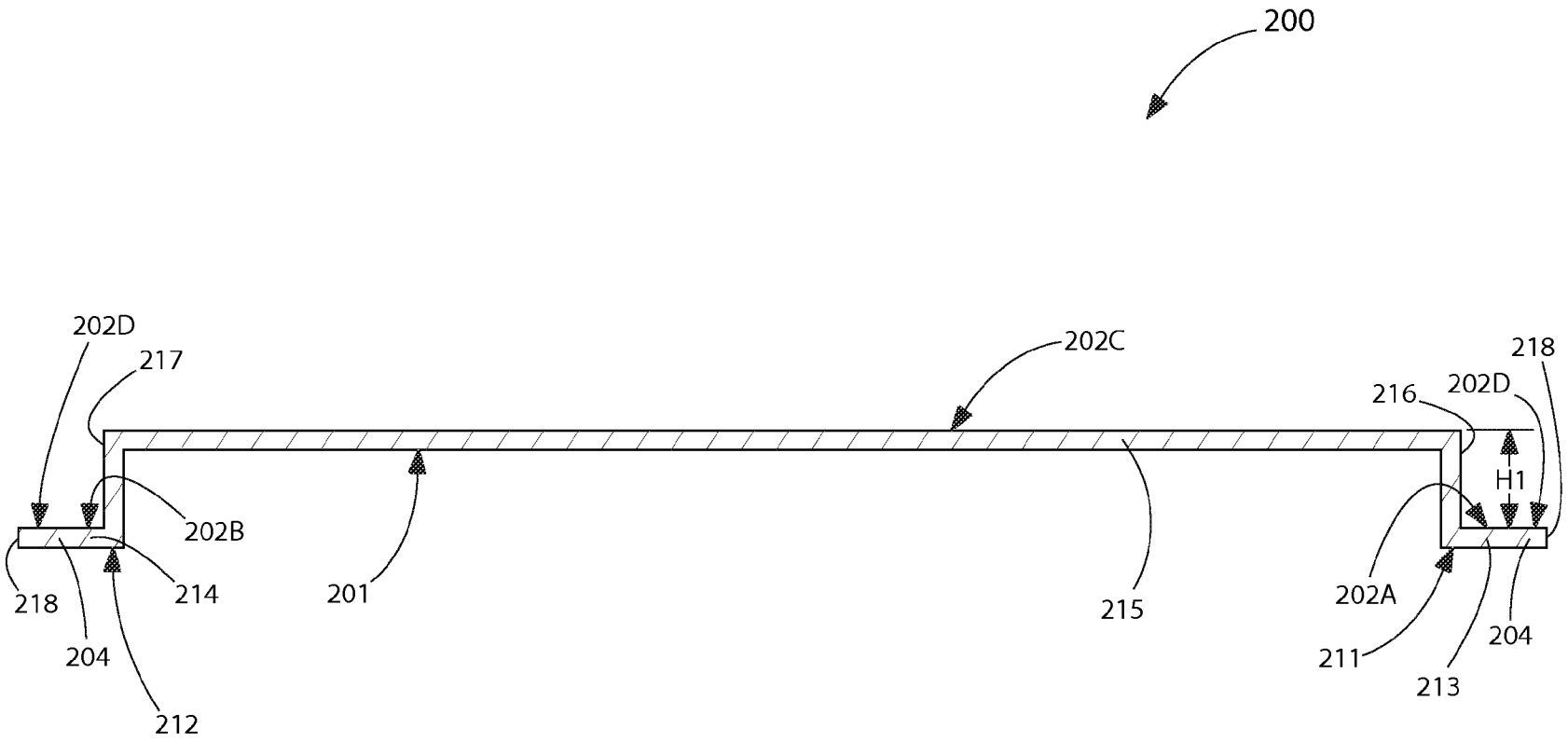
FIG. 4B is a cross-sectional view of the divider of FIG. 4A taken along view IX-IX of FIG. 4.
Figure 5:
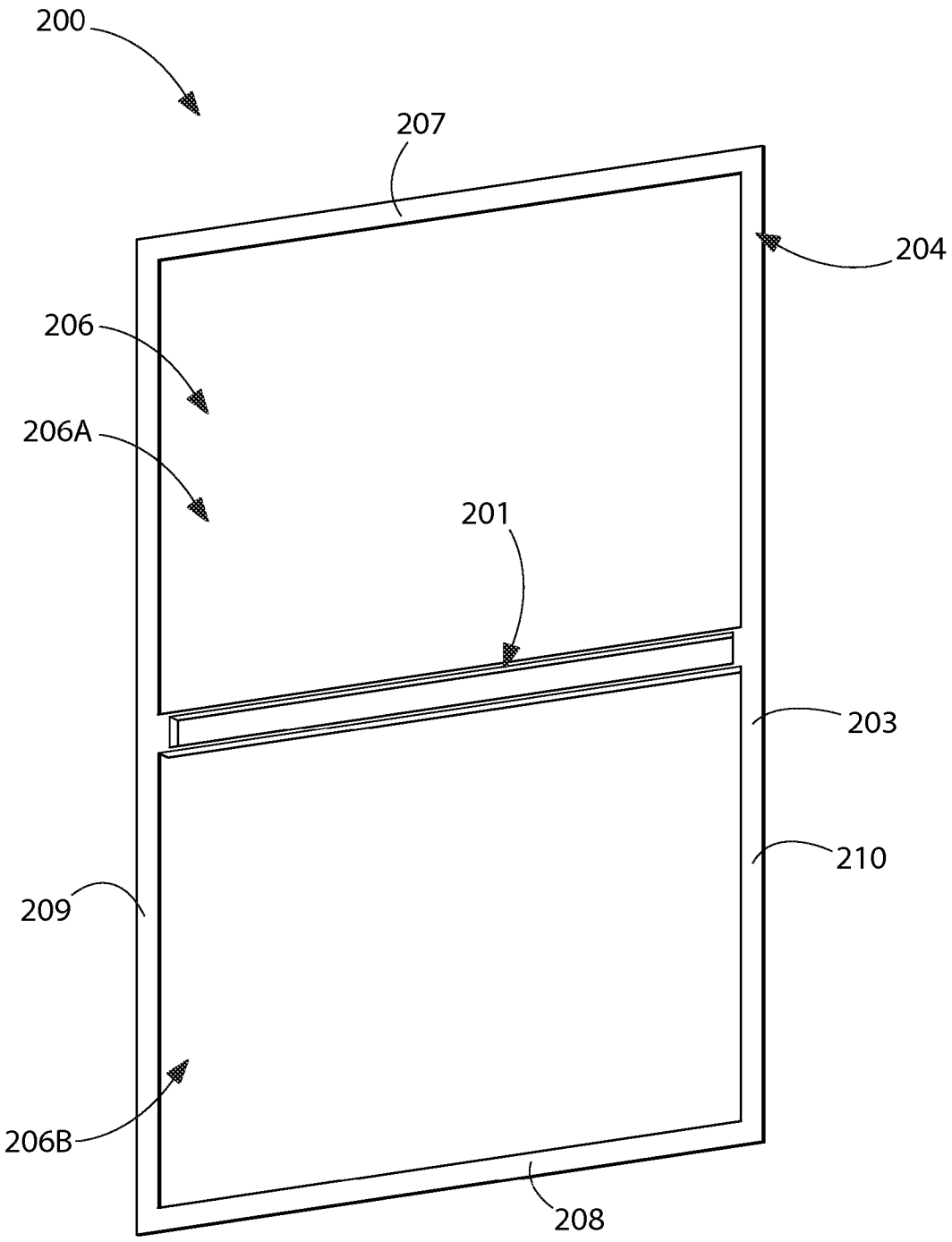
FIG. 5 is a rear perspective view of the divider of FIG. 4A.

Referring now to FIGS. 4A, 48 and 5 concurrently, details of the exemplified embodiment of the divider 200 will be discussed. The divider 200 comprises a divider member 201 and a divider frame 204. The divider frame 204 comprises an inner edge 205 that defines a divider opening 206. In the exemplified embodiment, the divider frame 204 forms a closed-geometry in the form of a rectangle. In other embodiments, the divider frame 204 may take on other closed-geometry shapes, including without limitation, oval, triangular, pentagonal, irregular-shaped, or other polygons. In still other embodiments, the divider frame 204 may not be a closed-geometry structure. Rather, in such embodiments, the divider frame 204 may include one or more gaps such that the divider frame 204 is a discontinuous structure.

The divider frame 204, as exemplified, is formed by a flattened strip that comprises a top member 207, a bottom member 208, a left-side member 209, and a right-side member 210. The divider member 201 comprises a first end 211 connected to the divider frame 204 and a second end 212 connected to the divider frame 204. In addition to dividing the display opening 101 into the first and second display windows 102, 103 when the divider 200 is coupled to the outer frame 100, the divider member 201 also divides the divider opening 206 into first and second divider windows 206A, 206B.

The first end 211 of the divider member 201 comprises a first connector section 213 while the second end 212 of the divider member 201 comprises a second connector section 214. The first connector section 213 connects the first end 211 of the divider member 201 to the right-side member 210 of the divider frame 204 while the second connector section 214 connects the second end 212 of the divider member 201 to the left-side member 209 of the divider frame 204. The divider member 201 further comprises a raised portion 215 that extends between the first and second connector portions 213, 214. The raised portion 215 of the divider member 200 terminates in a first end surface 216 at one end thereof and in a second end surface 217 at the opposite end thereof. As shown in FIGS. 1 and 6A, when the divider 200 is coupled to the outer frame 100, the raised portion 215 of the divider member 201 protrudes into the display opening 101 of the outer frame 100, which is defined the inner edge 108 of the outer frame 100. Moreover, in certain embodiments, when the divider 200 is coupled to the outer frame 100, the first end surface 216 of the raised portion 215 abuts a first portion of the inner edge 108 of the outer frame 100 while the second end surface 217 of the raised portion 215 abuts a second portion of the inner edge 108. By protruding into the display opening 101, and abutting the inner edge 108 of the outer frame, the raised portion 215 assists in ensuring that the divider 200 is in (and maintained in) proper relative position with respect to the outer frame 100, and more specifically, within the rabbet 110 of the outer frame 100. The divider member 210 also comprises side surfaces.

In one embodiment, the raised portion 215 of the divider member 201 has a height H1 measured from the front surfaces 202A,B of the first and second connector portions 213, 214 and a front surface 202C of the raised portion 215. The height H1, in certain embodiments, is substantially equal to the height H2 of the inner edge 108 of the outer frame 100 (FIG. 6A). As a result, the top surface 202C of the raised portion 215 creates a smooth interface with a front surface 109 of the outer frame 100. Thus, when the frame assembly 1000 is assembled and viewed from the front, the divider member 201 appears to be an integral part of the outer frame 100. In the exemplified embodiment, the divider member 201 has a generally U-shaped transverse cross-sectional profile. In other embodiments, the divider member 201 may have other transverse cross-sectional shapes as desired, such as rectangular.

The divider frame 204 comprises a front surface 202D and a rear surface 203. Conceptually, the front surfaces 202A-D of the first connector portion 213, the second connector portion 214, the raised portion 215 and the divider frame 204 collectively form the front surface 202 of the divider 200. In one embodiment, each of the front surfaces 202A-B of the first and second connector portions 213, 215 are substantially flush with the front surface 202D of the divider frame 204.

Figure 6B:
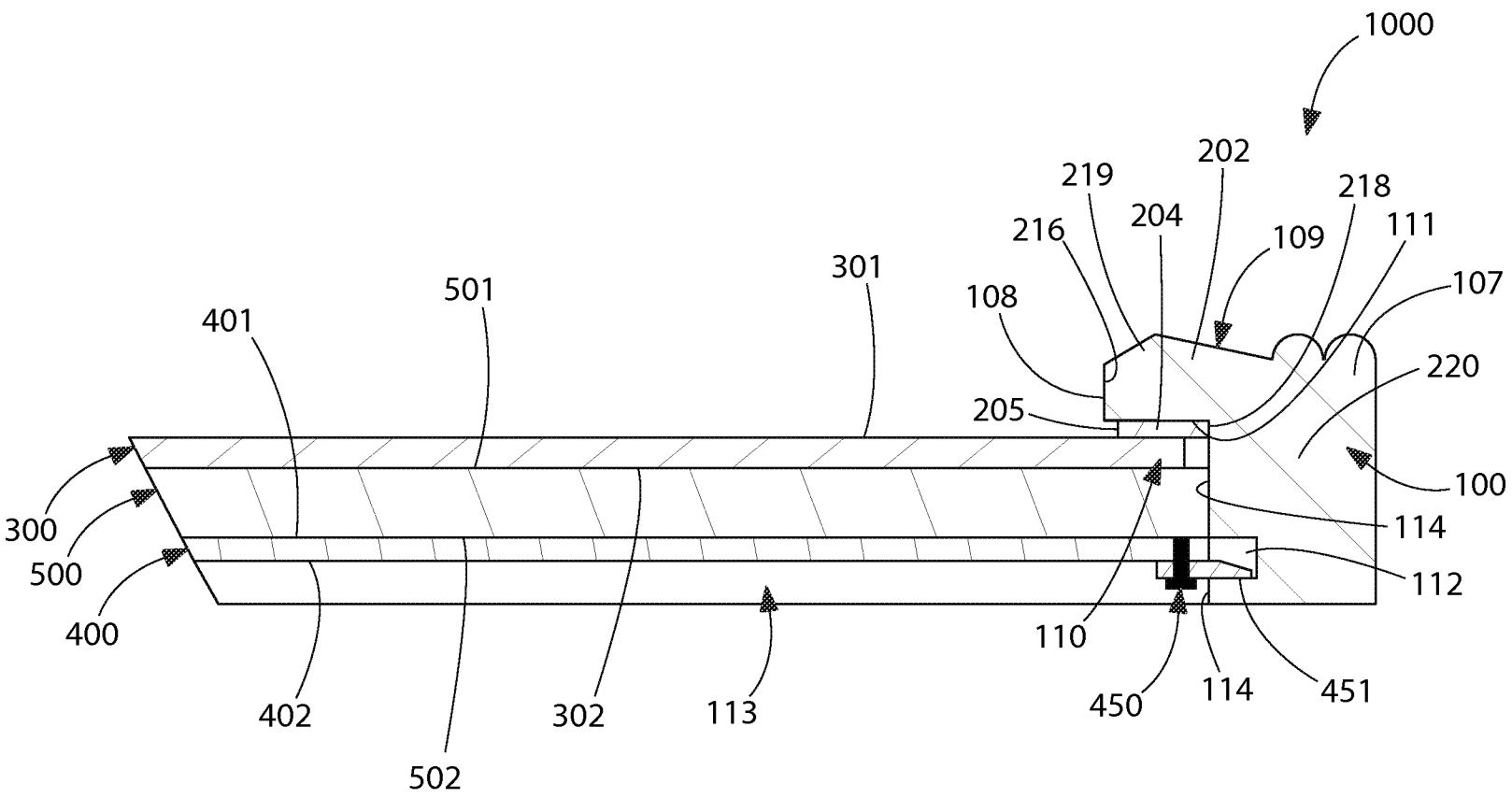
FIG. 6B is a cross-sectional view of the frame assembly of FIG. 1 taken along view X-X of FIG. 1.

Referring now to FIGS. 1 and 6A-B concurrently, the outer frame 100 comprises a wall portion 119 and a flange portion 120 extending from the wall portion 119. The flange portion 119 comprises the inner edge 108 of the outer frame 100 and the floor surface 111 of the rabbet 110. The wall portion 120 comprises an upstanding wall surface 114 of the rabbet 110 and a reas surface of the outer frame 100. When the divider 200 (and the rest of the stack) is coupled to the outer frame 100 as described above, the divider frame 204 nests fully within the rabbet 110. When so nested and coupled, the front surface 202D of the divider frame 204 is in surface contact with the floor surface 111 of the rabbet 110. In the exemplified embodiment, the inner edge 108 of the outer frame 100 extends beyond the inner edge 205 of the divider frame 204 (toward a center of the display opening 101). Thought of another way, the inner edge 205 of the divider frame 204 is offset from the inner edge 108 of the outer frame 100 in a direction into the rabbet 110. By inwardly offsetting the inner edge 205 of the divider frame 204 relative to the inner edge 108 of the outer frame 100, the divider frame 204 is essentially hidden from view when the frame assembly 1000 is assembled and viewed from the front thereof. Thus, the perception that the divider member 201 is an integral and natural part of the outer frame 100 is further increased.

More specifically, when viewed from the front of the flame assembly 1000, each of the top, bottom, left-side and right-side members 207-210 of the divider frame 204 are hidden from view by the flange portion 219 of the outer frame 100. Such an effect is desirable because in certain embodiments, as described below, the divider frame 204 of the divider 200 does not have a foil layer applied thereto and, thus, lacks the desired aesthetic appearance. However, as discussed below, after assembly, the divider member 201 is visible when viewed from the front of the frame assembly 1000. The divider member 201 may have an foil layer applied thereto to the appearance that the divider member 201 is formed integrally with the outer frame 100. In one such embodiment, only those surface of the divider member 201 that are visible from the front of the assembled frame assembly 100 have a foil layer applied thereto, such as the front surface 202C and the side surfaces (not numbered).

In certain embodiments, when the divider 200 (and the rest of the stack) is coupled to the outer frame 100 as described above, the outer edge 218 of the divider frame 204 abuts and is in surface contact with an upstanding wall surface 114 of the rabbet 110. In other embodiments, however, an annular space may separate the outer edge 218 of the divider frame 204 and the upstanding wall surface 114 of the rabbet 110. Irrespective of whether or not the outer edge 218 of the divider frame 204 and the upstanding wall surface 114 of the rabbet 110 are in contact, the nesting of the divider frame 204 within the rabbet 110 (in combination with the compression applied to the stack by the engagement of the backer panel 400 and the outer frame 100) helps ensure (and maintain) proper relative positioning of the divider 200 relative to the outer frame 100. Thus, the divider frame 204 prevents the divider 200 from sliding a substantial distance in any direction when positioned within the rabbet 110.

When the divider 200 (and the rest of the stack) is coupled to the outer frame 100 as described above, each of the first and second connector sections 213, 214 extend into the rabbet 110. In certain embodiments, each of the front surfaces 202A, 202B of the first and second connector sections 213, 214 are also in surface contact with the floor surface 111 of the rabbet 110. It should be noted that in certain alternate embodiments, the divider frame 204 can be omitted from the divider 200. In such an embodiment, the divider 200 will simply consist of one or more separate and distinct divider members 201. In such an embodiment, the divider member(s) 201 will be coupled to the outer frame 100 by the first and second connector sections 213, 214 merely extending into the rabbet 110 and being held therein as described above. Moreover, in certain other embodiments in which the divider frame 204 is omitted, proper positioning of the divider member(s) 201 within the display opening 101 (and relative to the outer flame 100) can be achieved by providing retaining features on the divider member(s) 201 and/or the outer frame 100. For example, in one such specific embodiment, aligned grooves may be formed in the floor surface 111 of the rabbet on opposite sides of the display opening 101 in which the first and second connector sections 213, 214 nest. As a result, proper positioning of the divider member(s) 201 is ensured, and sliding of the divider member(s) 201 within the rabbet 110, is prohibited by interference with the upstanding walls of the grooves. Alternatively, slots can be formed in the upstanding wall surface 114 of the rabbet 110 that receive end portions of the first and second connector sections 213, 214. In other specific embodiments, one of the floor surface of the rabbet 110 or the first and second connector sections 213, 214 of the divider member(s) 201 can be provided with a protuberance while the other one of the floor surface of the rabbet 110 or the first and second connector sections 213, 214 of the divider member(s) 201 can be provided with a corresponding depression (or hole) that mates with the protuberance. Alternatively, the upstanding wall surface 114 of the rabbet 110 can be provided with either the protuberance or the depression. Of course, other structural retaining features can be envisioned, such as barbs, ridges, notches, etc. In certain other embodiments, the divider frame 204 may be included such that the top and bottom members 207, 208 are omitted.

In certain embodiments, the divider 200 is an integrally formed single component. In an embodiment, the divider 200 is integrally formed as a single component using a molding process, such as injection molding. In one such injection molding embodiment, a mold haying a mold cavity that corresponds to the size and shape of the divider 200 is provided. A molten form of material, such as a thermoplastic, is injected into the mold cavity and allowed to cool, thereby forming the divider 200. Suitable thermoplastics include, without limitation, polymers and copolymers of styrene (i.e., polystyrene), ethylene, propylene (i.e., polypropylene), olefins, butadiene, vinyl compounds and polyesters, such as polyethylene terephthalate. Of course, other thermoplastics can be used as desired. In one specific embodiment, general purpose polystyrene is preferred to form the divider 200. In another specific embodiment, polypropylene is preferred to form the divider 200. Of course, other materials and plastics can be used as desired.

In other embodiments, the divider 200 can be integrally formed as a single component using a milling or machining, process. In still other embodiments, the divider 200 can be a multi-component assembly wherein the divider member 201 and divider frame 204 are formed and subsequently coupled at a later stage of manufacturing. The divider 200, in certain embodiments, can be formed of other materials, including without limitation, wood, medium-density fiberboard, metal, metal alloys, plastics, rubber, or combinations thereof.

In certain embodiments, the outer frame 100 if formed by an extruding process in which each of the outer frame components 104-107 are formed and then subsequently coupled together at their ends by any means known in the art, such as stapling, adhesion, soldering, thermal fusions, snap-fit, screws, nails, connector plates, or combinations thereof. As can be seen in FIG. 1, the ends of each of the plurality of outer frame members are appropriately mitered and coupled together to form the desired shape, which in the exemplified embodiment is a rectangle. The outer frame components 104-107 can be formed of a single material or a plurality of materials. As will be discussed in greater detail below, in certain embodiments the outer frame components 104-107 may be formed by a co-extrusion process.

In one embodiment, the outer frame components 104-107 (and thus the outer frame 100) can be formed of a polymer (thermoplastics and thermosets), wood, medium-density fiberboard, metal, metal alloys, plastics, rubbers, or combinations thereof In one such embodiment, the outer frame components 104-107 (and thus the outer frame 100) can be formed by an extruded polymer. In one specific embodiment, the outer frame components 104-107 are extruded from a general purpose polystyrene. In another embodiment, the outer frame components 104-107 are co-extruded from an expanded polymer and a non-expanded polymer. In one such specific embodiment, the outer frame components 104-107 are co-extruded from an expanded polystyrene (such as a polystyrene foam) and a general purpose polystyrene.

In certain alternate embodiments, the outer frame 100 can be an integrally formed as a single component. This can be accomplished by an injection molding, machining or milling process as discussed above for the divider 200. Suitable materials for forming the outer frame 100, in certain such embodiments, include thermoplastics (such as those described above for the divider 200), wood, medium-density fiberboard, metal, metal alloys, plastics, rubbers, or combinations thereof.

Figure 7:
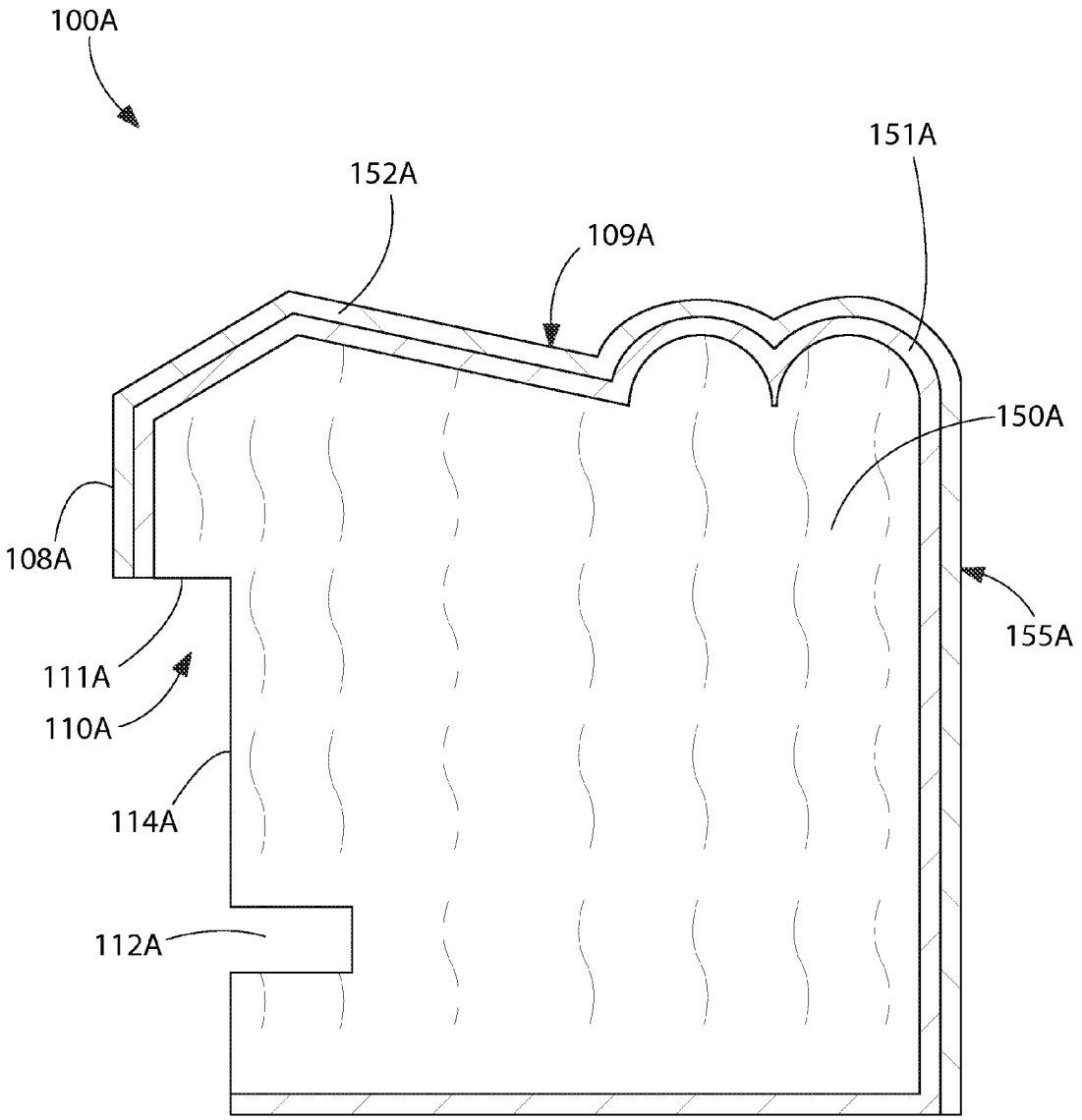
FIG. 7 is a cross-sectional view of an outer frame in accordance with another embodiment of the present invention.

Referring now to FIG. 7, an alternative construction of an outer frame 100A that can be used in the frame assembly 1000 instead of the outer frame 100 is illustrated. The Outer frame 100A can be used in conjunction with the divider 200 discussed above or the divider 200A discussed below. in still other embodiments, the outer frame 100A can be used without either of the dividers 220, 200A. The structure of the outer frame 100A is identical to that of the outer frame 100 discussed above except with respect to its multi-layer construction and materials of construction as discussed in greater detail below. Thus, only those aspects of the frame components 100A that differ from the outer frame 100 are discussed below with the understanding that the above discussion of the outer frame 100 is applicable to the outer frame 100A. Thus, like numbers will be used for like components with the exception that the suffix "A" has been added to the reference numbers.

The outer frame 100A (and each of its frame components 104A-107A) comprises a core 150A, a cap layer 151A, and a foil layer 152A. In certain embodiments, the cap layer 151A can be omitted while in other embodiments the fold layer 152A may be omitted. The cap layer 151A overlies the core 150A. In the exemplified embodiment, the cap layer 151A directly overlies the core 150A without any intervening layers. However, in alternate embodiments, the cap layer 151A may indirectly overlie the core 150A with one or more intervening layers disposed therebetween. In the exemplified embodiment, the foil layer 152A indirectly overlies the core 150A and directly overlies the cap layer 151A. in other embodiments, the cap layer 151A is omitted and, thus, the foil layer 152A directly overlies the core 150A. In still other embodiments, other intervening layers, in addition to the cap layer 151 can be disposed between the cap layer 151A and the foil layer 152A.

In the exemplified embodiment, the cap layer 151A does not completely encase the core 150A. Rather, the cap layer 151 only overlies those portions of the core 150A that are visible from the rear, front and sides when the outer frame 100A is assembled to form a frame assembly 1000. In other embodiments, however, the cap layer 151A may cover less of the core 150A than exemplified. In still other embodiments, the cap layer 151A can encase the entirety of the core 150A.

In certain embodiments, the cap layer 151A provides the outer frame 100A with rigidity that may not be provided by the core 150A. The foil layer 152A provides the outer frame 100A with a desired aesthetic (discussed in greater detail below). In certain embodiments, the cap layer 151A may also be capable of (or of being adequately finished) to provide the desired aesthetic for the outer frame 100 such that the foil layer 152A is not necessary. For example, certain general purpose polymers and/or high impact polymers can be used to form the cap layer 151A and provide a suitable smooth finish in white or black.

In certain embodiments, the cap layer 151A and the core 150A can be formed simultaneously using a co-extrusion process. In other embodiments, the core 150A can be formed first and the cap layer 151A can be subsequently added to the core 150A. In such an embodiment, the core 150A can be formed by extrusion and the cap layer 151A can be added to the core 150A via a subsequent extrusion process. Of course, other formation techniques can be utilized. In one specific embodiment, the core 150A can be formed of an expanded polymer including without limitation a polymer foam, while the cap layer 151A is formed of a non-expanded polymer, including without limitation a general purpose polymer or a high impact polymer. In one embodiment, the core 150A is formed of an expanded polystyrene while the cap layer 151A is formed of a non-expanded polystyrene. More specifically, in one such embodiment, the core 150A is formed of a polystyrene foam while the cap layer 151A is formed of a general purpose polystyrene. Of course, other polymer materials (other than polystyrene) can be used to form the expanded polymer core 150A and the non-expanded polymer cap layer 151A. Suitable alternate polymer materials include ethylene, propylene (i.e., polypropylene), olefins, butadiene, vinyl compounds and polyesters, such as polyethylene terephthalate. Of course, other thermoplastics, thermosets and other materials can be used in certain embodiments.

In certain embodiments, the core 150A and/or the cap layer 151A is covered with the foil layer 153A using a foiling process. One suitable foiling process uses heat and pressure to adhere the foil layer 152A to the cap layer 151A or the core 150A. The foil layer 152A provides the outer frame 100A with a desired aesthetic appearance. In certain embodiments, the desired aesthetic appearance is a wood grain appearance. In certain other embodiments, the desired appearance may be a metallic appearance, a colored appearance, a marbled appearance, a textured appearance, a ceramic appearance, a stone appearance, or the like. In one embodiment, the foil layer 152A is formed of or comprises a material that is compatible with the material of the cap layer 151A or the core 150A to which it is directly applied. In one specific embodiment in which the cap layer 151A is formed of polystyrene, the foil layer 152A is formed of a foil that is compatible with polystyrene. In one such embodiment, the foil layer 152A may comprise polystyrene.

In the exemplified embodiment, the foil layer 152A only covers the cap layer 151A on those portions of the outer frame 100 that are visible to a user when the frame assembly 1000 is mounted to a surface, such as a wall surface. Thus, the foil layer 152A, in the exemplified embodiment, forms a portion of the outer surface 155A of the outer frame 100A. As exemplified, the foil layer 152A covers the inner edge 108, the front surface, and the outer side surfaces of the outer frame 100A. This reduces materials costs by reducing the amount of foil used. Of course, in other embodiments, the foil layer 152A can Cover and/or encase the entirety of the cap layer 151A or the core 150A.

Figure 8:
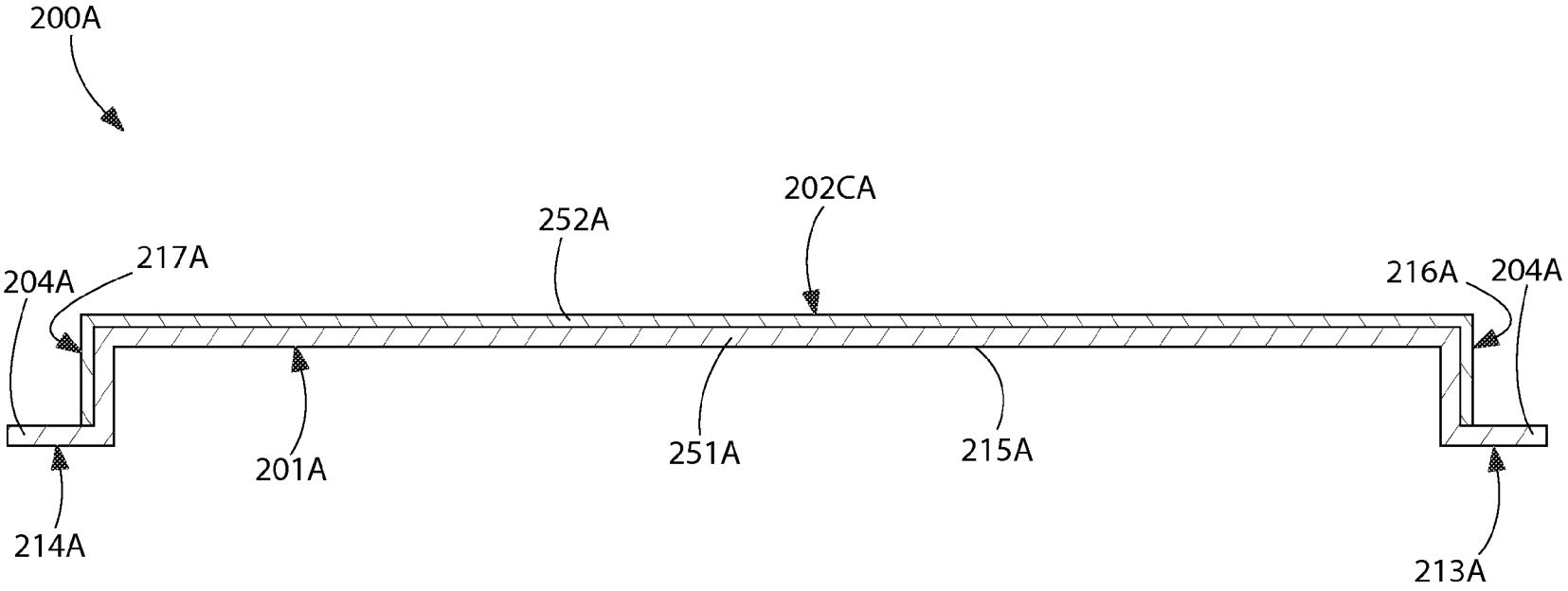
FIG. 8 is a cross-sectional view of a divider in accordance with another embodiment of the present invention.
Figure 9:
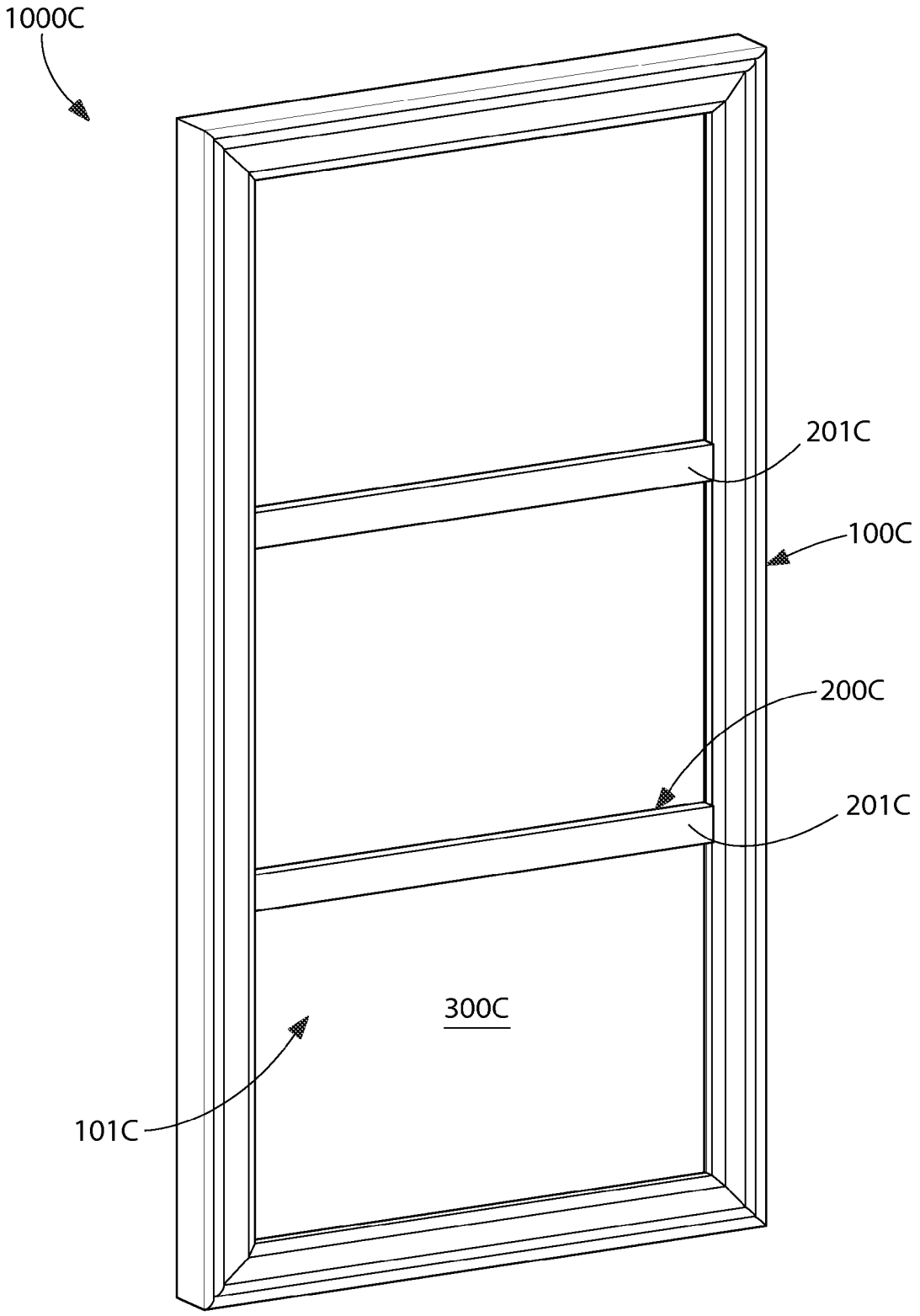
FIG. 9 is a front perspective view of a frame assembly in accordance with another embodiment of the preset invention.

Referring now to FIG. 8, an alternative construction of a divider 200A that can be used in the frame assembly 1000 instead of the divider 200 is illustrated. The divider 200A can be used in conjunction with the outer frame 100A or the outer frame 100 as discussed above. The structure of the divider 200A is identical to that of the divider 200 discussed above except with respect to its multi-layer construction and materials of construction as discussed in greater detail below. Thus, only those aspects of the divider 200A that differ from the divider 200 are discussed below with the understanding that the above discussion of the divider 200 (and its interaction in the frame assembly 1000) is applicable to the divider 200A. Thus, like numbers will be used for like components with the exception that the suffix "A" has been added to the reference numbers.

The divider 200A comprises a divider frame 204A and a divider member 201A. The divider member 201A comprises a base structure 251A and a foil layer 252A overlying the base structure 251A. In the exemplified embodiment, the foil layer 252A directly overlies the base structure 251A. In other embodiments, the foil layer 252A may indirectly overlie the base structure 251A in that one or more intervening layers may be provided between the foil layer 252A and the base structure 251A.

The base structure 251A provides the structural rigidity to the divider member 201A while the foil layer 252A provides the divider member 201A with the desired aesthetic appearance. In the exemplified embodiment, the foil layer 252 is only provided on the base structure 251A of the divider member 201A and not on the divider frame 204A. Moreover, in the exemplified embodiment, the foil layer 252A forms only those portions of the outer surface 255A of the divider member 201A that are visible when the frame assembly 1000 is assembled, such as the front surface 202CA, the end surfaces 216A-217A, and the side surfaces (not numbered). In other embodiments, the entirety of the base structure 251A can be encased in the foil layer 252A. if desired, the foil layer 252A may also be applied to the outer frame 204A.

In certain embodiments, the base structure 251A is formed of any of the materials discussed above for the divider 200 and is formed integrally with the divider frame 204A. in another embodiment, the base structure 251A can be formed out of the same material as the cap layer 151A discussed above for the outer frame 100A.

The foil layer 252A is a foil that provides the divider member 201A with a desired appearance, preferably an appearance that matches the appearance of the foil layer 152A of the outer frame 100A (or the appearance of the outer frame 100 when no foil layer 142A is used). One suitable foiling, process uses heat and pressure to adhere the foil layer 252A to the base structure 251A. in certain embodiments, the desired aesthetic appearance imparted by the foil layer 252A is a wood grain appearance. in certain other embodiments, the desired appearance may be a metallic appearance, a colored appearance, a marbled appearance, a textured appearance, a ceramic appearance, a stone appearance, or the like. In one embodiment, the foil layer 252A is formed of or comprises a material that is compatible with the material of the base structure 251A (or intervening layer) to which it is directly applied. In one specific embodiment in which the base structure 251A is formed of polystyrene, the foil layer 252A is formed of a foil that is compatible with polystyrene. In one such embodiment, the foil layer 252A may comprise polystyrene.

In some embodiments, the base structure 251A (and the divider frame 204A if provided) is formed of thermoplastic using an injection molding process as discussed above for the divider 200. Thus, in certain embodiments, the base structure 251A can be formed of thermoplastics including, without limitation, polymers and copolymers of styrene (i.e., polystyrene), ethylene, propylene (i.e., polypropylene), olefins, butadiene, vinyl compounds and polyesters, such as polyethylene terephthalate. Of course, other polymers and other materials can be used in certain embodiments.

In certain embodiments of the frame assembly of the present invention, the materials of the outer frame 100A and the material(s) of the divider 200 or 200A are relatively selected to achieve certain manufacturing and/or price point objectives while at the same achieving a desired aesthetic and/or structural quality. In such embodiments, the foil layers may or may not be included.

In one certain embodiment, the frame assembly is formed such that: (1) the outer frame 100A is constructed so that the core 150A is formed of a first material and the cap layer 151A is formed of a second material; and (2) the divider member 201 (or the base structure 251A of the divider member 201A) is also formed of the second material. For purposes of simplicity, in certain instances, when it is said that the divider member 201A is formed of a material, it means that the base structure 252A is formed of that material. The cap layer 151A and the divider member 201 (or the base structure 251A of the divider member 201A) are formed of the same material. In one such embodiment, the first material has a first density while the second material has a second density that is greater than the first density. In one embodiment, the first material is a low density thermoplastic and the second material is a high density thermoplastic. In another embodiment, the first material can an expanded polymer and the second material can be a non-expanded polymer. In one embodiment, the expanded polymer is an expanded thermoplastic and the non-expanded polymer is a non-expanded thermoplastic. Examples of expanded thermoplastics include thermoplastic foams (open or closed cell) while examples of non-expanded thermoplastics include general purpose thermoplastics and high impact thermoplastics. One specific example of a thermoplastic foam is a polystyrene foam while one example of general purpose thermoplastic and high impact thermoplastic is general purpose polystyrene or high impact polystyrene. In addition to polystyrene for the aforementioned examples, any of the thermoplastics discussed above, such as polymers and copolymers of ethylene, propylene (i.e., polypropylene), olefins, butadiene, vinyl compounds and polyesters, can be used for the first and/or second materials.

In another certain embodiment, the frame assembly is formed such that: (1) the outer frame 100A is constructed such that the core 150A is formed of an expanded thermoplastic and the cap layer is formed of a non-expanded thermoplastic; and (2) the divider member 201 (or the base structure 251A of the divider member 201A) is also formed of a non-expanded thermoplastic. In one such embodiment, the cap layer 152A and the divider member 201 (or the base structure 251A of the divider member 201A) are formed of the same non-expanded thermoplastic in another such embodiment, the cap layer 152A and the divider member 201 (or the base structure 251A of the divider member 201A) are formed of different non-expanded thermoplastics. Examples of expanded thermoplastics include thermoplastic foams (open or closed cell), such as polystyrene foam. Examples of non-expanded thermoplastics include general purpose thermoplastics and high impact thermoplastics, such as general purpose polystyrene or high impact polystyrene in addition to polystyrene for the aforementioned examples, any of the thermoplastics discussed above, such as polymers and copolymers of ethylene, propylene polypropylene), olefins, butadiene, vinyl compounds and polyesters, can be used for the first and/or second materials.

In yet another certain embodiment, the frame assembly is formed such that: (1) the outer frame 100A is constructed so that the core 150A is formed of a material having a first density and the cap layer 151A is formed of a material having a second density; and (2) the divider member 201 (or the base structure 251A of the divider member 201A) is formed of a material having a third density, wherein the first density is less than the second and third densities. In one such embodiment, the second and third densities are different. In another such embodiment, the second and third densities are the same. In one specific embodiment, the core 150A is formed of an expanded thermoplastic, such as polystyrene foam, while the cap layer is formed of a non-expanded thermoplastic, such as general purpose polystyrene or high impact polystyrene. The divider member 201 (or the base structure 251A of the divider member 201A), in certain embodiments, can be formed of general purpose polypropylene, general purpose polystyrene, high impact polystyrene or high impact polypropylene. Of course, other hard plastics and thermoplastics, as discussed above, can be used.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments ma be utilized and structural and functional modifications may be made without departing from the scope of the present invention. Thus, the spirit and scope of the invention should be construed broadly as set forth in the appended claims.

What is claimed is:

1. A frame assembly comprising:

an outer frame comprising an inner edge defining a display opening, the outer frame comprising a rabbet circumscribing the display opening;

a divider coupled to the outer frame, the divider comprising:

a divider frame having an inner edge defining a divider opening, the divider frame nesting within the rabbet; and a divider member having a first end connected to the divider frame and a second end connected to the divider frame, the divider member extending across the display opening to divide the display opening into at least a first display window and a second display window;

wherein the divider frame has a front surface that is in surface contact with a floor surface of the rabbet, the divider member comprising a raised portion that protrudes into the display opening; and wherein the raised portion of the divider member has a first end surface and a second end surface, the first end surface of the raised portion abutting a first portion of the inner edge of the outer frame and the second end surface of the raised portion abutting a second portion of the inner edge of the outer frame; and wherein the first end of the divider member comprises a first connector section and the second end of the divider member comprises a second connector section, each of the first and second connector sections having a front surface that is substantially flush with the front surface of the divider frame and in surface contact with the floor surface of the rabbet.

2. The frame assembly according to claim 1 wherein the outer frame comprise a core formed of a first material and a cap layer overlying the core formed of a second material; and wherein the entirety of the divider is formed of the first material.

3. The frame assembly according to claim 1 wherein the outer frame comprises a foil layer forming an outer surface of the outer frame and the divider member comprises a foil layer forming an outer surface of the divider member.

4. The frame assembly according to claim 1 further comprising:

a glazing nested in the rabbet, the divider frame positioned between a front surface of the glazing and the floor surface of the rabbet; and a backer panel coupled to the outer frame to hold the glazing and divider frame in place within the outer frame.

5. The frame assembly according to claim 1 wherein the divider is an integrally formed single component.

6. The frame assembly according to claim 1 wherein the inner edge of the outer frame extends beyond the inner edge of the divider frame.

7. The frame assembly according to claim 5 wherein the outer frame is formed by a plurality of extruded outer frame members that are coupled together.

* * * * *